US010505319B2

(12) United States Patent
Hayasaka et al.

(10) Patent No.: US 10,505,319 B2
(45) Date of Patent: Dec. 10, 2019

(54) DEVICE DIRECT-MOUNTING SHIELD CONNECTOR

(71) Applicant: YAZAKI CORPORATION, Tokyo (JP)

(72) Inventors: Noboru Hayasaka, Shizuoka (JP); Yasuhiro Tanaka, Shizuoka (JP); Hiroaki Ono, Shizuoka (JP); Toru Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/059,020

(22) Filed: Aug. 8, 2018

(65) Prior Publication Data

US 2019/0067877 A1 Feb. 28, 2019

(30) Foreign Application Priority Data

Aug. 28, 2017 (JP) ..... 2017-163053

(51) Int. Cl.
*H01R 13/6581* (2011.01)
*H01R 13/52* (2006.01)
(Continued)

(52) U.S. Cl.
CPC ..... *H01R 13/6581* (2013.01); *H01R 13/422* (2013.01); *H01R 13/512* (2013.01);
(Continued)

(58) Field of Classification Search
CPC ..... H01R 13/6581; H01R 13/422; H01R 13/512; H01R 13/5202
(Continued)

(56) References Cited

U.S. PATENT DOCUMENTS 5,259,773 A * 11/1993 Champion ..... H01R 13/658 439/108
5,277,624 A * 1/1994 Champion ..... H01R 23/6873 439/607.13
(Continued)

FOREIGN PATENT DOCUMENTS

CN 205565132 U 9/2016
JP 10-506224 A 6/1998
(Continued)

*Primary Examiner* — Tulsidas C Patel
*Assistant Examiner* — Peter G Leigh
(74) *Attorney, Agent, or Firm* — Kenealy Vaidya LLP

(57) ABSTRACT

A device direct-mounting shield connector configured to be installed in an opening section in a metal casing, includes a nonconductive connector housing and a metal shield shell. The connector housing has a cylindrical hood section which includes a terminal housing section. The metal shield shell is installed in the connector housing and covers a circumference of the terminal housing section. The shield shell integrally has an exposed section and a fastening section. The exposed section is configured to contact to a shield shell of the mating connector when the mating connector is fitted with the connector housing. The fastening section has a through hole at a rear end side of the connector housing. The shield shell is fastened to the casing by passing a bolt into the through hole and a bolt hole in the casing and by tightening the bolt.

7 Claims, 4 Drawing Sheets

(51) Int. Cl.

| | |
|---|---|
| ***H01R 13/512*** | (2006.01) |
| ***H01R 13/422*** | (2006.01) |
| ***H01R 13/6596*** | (2011.01) |
| *H01R 13/6582* | (2011.01) |
| *H01R 13/74* | (2006.01) |

(52) U.S. Cl.
CPC ..... *H01R 13/5202* (2013.01); *H01R 13/6596* (2013.01); *H01R 13/6582* (2013.01); *H01R 13/748* (2013.01)

(58) Field of Classification Search
USPC ..... 439/589
See application file for complete search history.

(56) References Cited

U.S. PATENT DOCUMENTS 5,356,301 A * 10/1994 Champion ..... H01R 13/6582 439/108
5,429,520 A * 7/1995 Morlion ..... H01R 12/712 439/108
5,564,945 A 10/1996 Domingos et al.
6,328,579 B1 12/2001 Mori et al.
6,475,034 B1 * 11/2002 Zhang ..... H01R 13/26 439/607.4
6,623,301 B2 * 9/2003 Lappoehn ..... H01R 13/6581 439/607.36
7,540,777 B2 * 6/2009 Lappoehn ..... H01R 13/6581 439/607.01
9,124,021 B2 * 9/2015 Kashiwada ..... H01R 13/512
9,368,902 B2 * 6/2016 Nakai ..... H01R 13/5202
9,570,899 B2 * 2/2017 Tanaka ..... H02G 15/007
9,640,916 B2 * 5/2017 Nakai ..... H01R 13/506
2002/0002014 A1 * 1/2002 Ichioka ..... H01R 9/05 439/625
2002/0155756 A1 10/2002 Yoshioka
2011/0045693 A1 2/2011 Uchida
2012/0238138 A1 * 9/2012 Matsuoka ..... H01R 4/64 439/607.55
2012/0295479 A1 11/2012 Omae et al.
2014/0120767 A1 * 5/2014 Itsuki ..... H01R 13/5208 439/587
2016/0240982 A1 * 8/2016 Ohkubo ..... H01R 9/032

FOREIGN PATENT DOCUMENTS

JP 2000-215947 A 8/2000
JP 2002-313453 A 10/2002
JP 2008-041600 * 2/2008 ..... H01R 13/648
JP 2008-41600 A 2/2008
JP 2011-44327 A 3/2011
JP 2011-159535 A 8/2011

* cited by examiner

DEVICE DIRECT-MOUNTING SHIELD CONNECTOR

CROSS REFERENCE TO RELATED APPLICATIONS

This application is based on Japanese Patent Application (No. 2017-163053) filed on Aug. 28, 2017, the contents of which are incorporated herein by reference.

BACKGROUND OF THE INVENTION

1. Field of the Invention

The present invention relates to a device direct-mounting shield connector.

2. Description of the Related Art

Conventionally, device direct-mounting shield connectors have been proposed (refer to JP-A-2008-41600). Such a device direct-mounting shield connector is installed in the opening section formed in a metal casing. This device direct-mounting shield connector is equipped with a resin-made connector housing having a terminal housing section for housing terminals and bolted to the casing and a metal shield shell attached to the connector housing and covering the circumference of the terminal housing section.

In the device direct-mounting shield connector configured as described above, the shield shell has an elastic contact piece. In the case that the flange section of the connector housing is bolted to the casing, the elastic contact piece of the shield shell is pressed against the casing. Hence, the device direct-mounting shield connector is fixed to the casing, and the shield shell and the casing make contact with each other, thereby being electrically connected to each other.

However, in the device direct-mounting shield connector described in JP-A-2008-41600, since bolt insertion holes are formed in the flange of the connector housing and the flange is fixed to the casing with bolts using the insertion holes, the following problems may occur.

Like the connector housing, the flange is made of an insulating resin. It is known that this kind of resin causes permanent set in fatigue, and metal collars are insert-molded or press-fitted into the insertion holes of the flange in some cases to prevent the problem of falling off of bolts due to the permanent set. However, in the case that the metal collars are fixed to the resin-made flange by the insert-molding or press-fitting, the flange is required to be made larger in thickness and size to some extent to hold the collars, to prevent the collars from rotating and to prevent the flange from being cracked due to thermal shock or the like, thereby causing the upsizing of the device direct-mounting shield connector.

SUMMARY OF THE INVENTION

The present invention has been made to solve the conventional problems described above and an object of the present invention is to provide a device direct-mounting shield connector capable of being downsized.

The device direct-mounting shield connector according to the present invention is a device direct-mounting shield connector configured to be installed in an opening section formed in a metal casing, including a nonconductive connector housing having a cylindrical hood section including a terminal housing section for housing a conductive terminal and the connector housing being configured to be fitted with a mating connector from a tip end side of the connector housing; and a metal shield shell installed in the connector housing and covering the circumference of the terminal housing section, wherein the shield shell integrally has an exposed section and a fastening section, wherein in a state that the shield shell is installed in the connector housing, the exposed section is exposed to an inside of the hood section and is configured to contact to a shield shell of the mating connector when the mating connector is fitted with the connector housing, and wherein the fastening section has a through hole and is formed at a rear end side of the connector housing on the opposite side of the tip end side, and the shield shell is fastened to the casing by passing a bolt into the through hole provided in the fastening section and a bolt hole formed in the casing and by tightening the bolt.

With the device direct-mounting shield connector according to the present invention, since the shield shell constituting the contact point making contact with the shield shell of the mating connector is fastened to the casing, even if the metal collar is provided, the metal collar is not required to be fastened to a resin-made member. Furthermore, since the problem of falling off of the bolts due to permanent set in fatigue in the resin-made flange does not occur, the metal collar itself can be made unnecessary. Consequently, it is not necessary to ensure the size and the thickness of the flange, whereby the present invention can provide the device direct-mounting shield connector capable of being downsized.

Furthermore, the device direct-mounting shield connector according to the present invention is further equipped with a waterproofing member configured to prevent water from intruding from the opening section via a clearance between the connector housing and the casing in the state that the connector housing is installed in the opening section, wherein the shield shell is integrated with the connector housing by embedding or press-fitting, and the fastening section is fastened to the casing at an outside of the waterproofing member.

Since the shield shell is integrated with the connector housing by embedding or press-fitting, a locking structure or the like is not required to assemble the two components with each other, and the connector itself is suppressed from being upsized. Moreover, since the fastening section serving as the contact point portion of the shield shell and the casing is positioned outside the waterproofing member, this configuration can contribute to decreasing of the waterproof area, whereby the waterproofing member and the opening section of the casing can be suppressed from being upsized and the connector itself can eventually be suppressed from being upsized. Consequently, the present invention can provide the device direct-mounting shield connector capable of being further downsized.

Moreover, in the device direct-mounting shield connector according to the present invention, a catching face is formed at the tip end side of the connector housing so as to be enlarged in diameter in a tapered shape to catch the mating connector, and the exposed section of the shield shell has a tapered inclined face being continuous to and flush with the catching face.

With the device direct-mounting shield connector, since the exposed section including the tapered inclined face being continuous to and flush with the catching face is exposed, the shield shell is enlarged in diameter toward the tip end side. Even if the mating connector makes slide contact with or collides with the end section of the exposed section, the shield shell can be made hardly deformed inward.

Still further, the device direct-mounting shield connector according to the present invention is further equipped with a metal collar installed in the bolt hole of the casing, wherein the collar is integrally formed with or connected to the shield shell.

With the device direct-mounting shield connector, since the metal collar is integrated with or connected to the shield shell, the area of the shield shell making contact with the casing is increased by the collar portion, whereby this configuration can contribute to utilization of a stable shielding effect.

The present invention can provide a device direct-mounting shield connector capable of being downsized.

DETAILED DESCRIPTION OF THE EXEMPLARY EMBODIMENTS

The present invention will be described below along with embodiments. However, the present invention is not limited to the embodiments described below, but can be modified appropriately within the scope not departing from the gist of the present invention. Furthermore, although the illustration and description of some components are omitted in the embodiments described below, it is needless to say that known or well-known technologies are applied appropriately to the details of the omitted technologies within a range not causing inconsistency with the contents of the following description.

Figure 1:
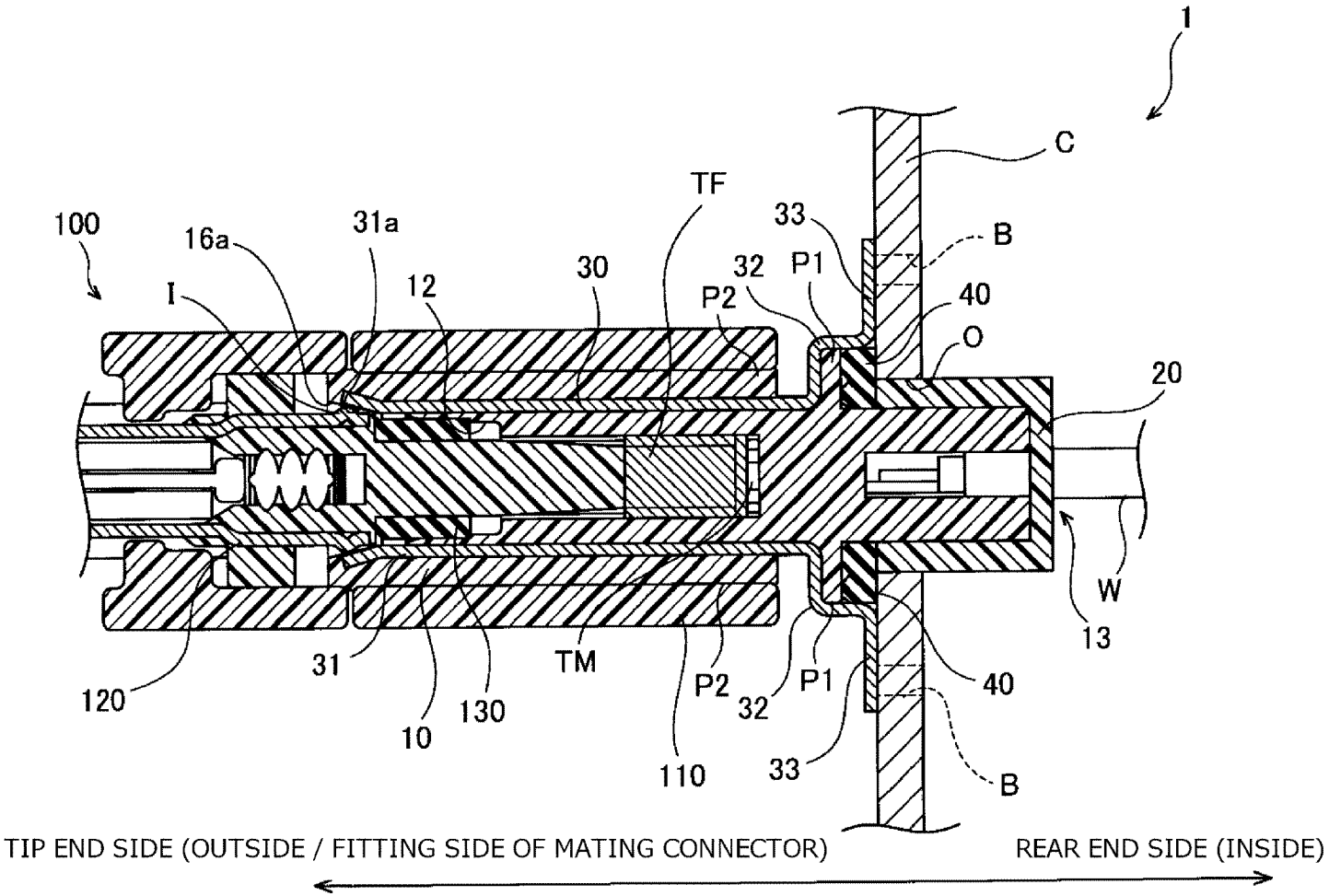
FIG. 1 is a sectional view showing a connector fitting structure including a device direct-mounting shield connector according to a first embodiment of the present invention.

FIG. 1 is a sectional view showing a connector fitting structure including a device direct-mounting shield connector according to a first embodiment of the present invention. As shown in FIG. 1, the connector fitting structure is equipped with a device direct-mounting shield connector 1 and a mating connector 100.

The mating connector 100 is generally equipped with a connector housing 110, a shield shell 120 and a packing 130.

The connector housing 110 is made of a nonconductive synthetic resin, and a shield shell 120 made of a metal and having a cylindrical shape is attached thereto. Furthermore, female terminals TF are inserted into the connector housing 110. These female terminals TF are electrically connected to the core wires of shielded wires, not shown. The shielded wires are each equipped with a shielding layer, such as a braid, around the core wire. The shielding layer is crimped together with the shield shell 120 by a shield sleeve, not shown. Hence, the shielding layer becomes conductive with the shield shell 120.

An indent I serving as an outward protruding section is formed on the shield shell 120 on the side of the device direct-mounting shield connector 1. Moreover, the packing 130 is provided inside the connector housing 110 slightly closer to the side of the device direct-mounting shield connector 1 than to the shield shell 120. The packing 130 is, for example, a ring member made of rubber.

Figure 2:
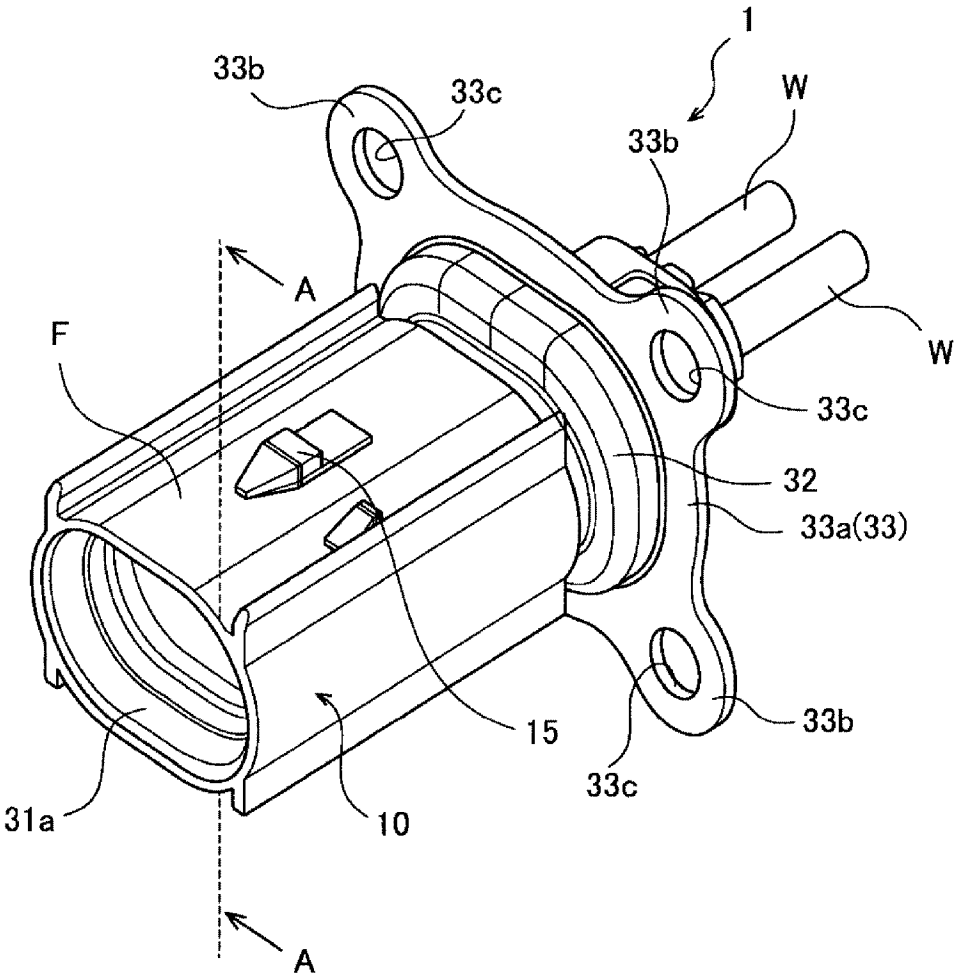
FIG. 2 is a perspective view showing the device direct-mounting shield connector according to the first embodiment.
Figure 3:
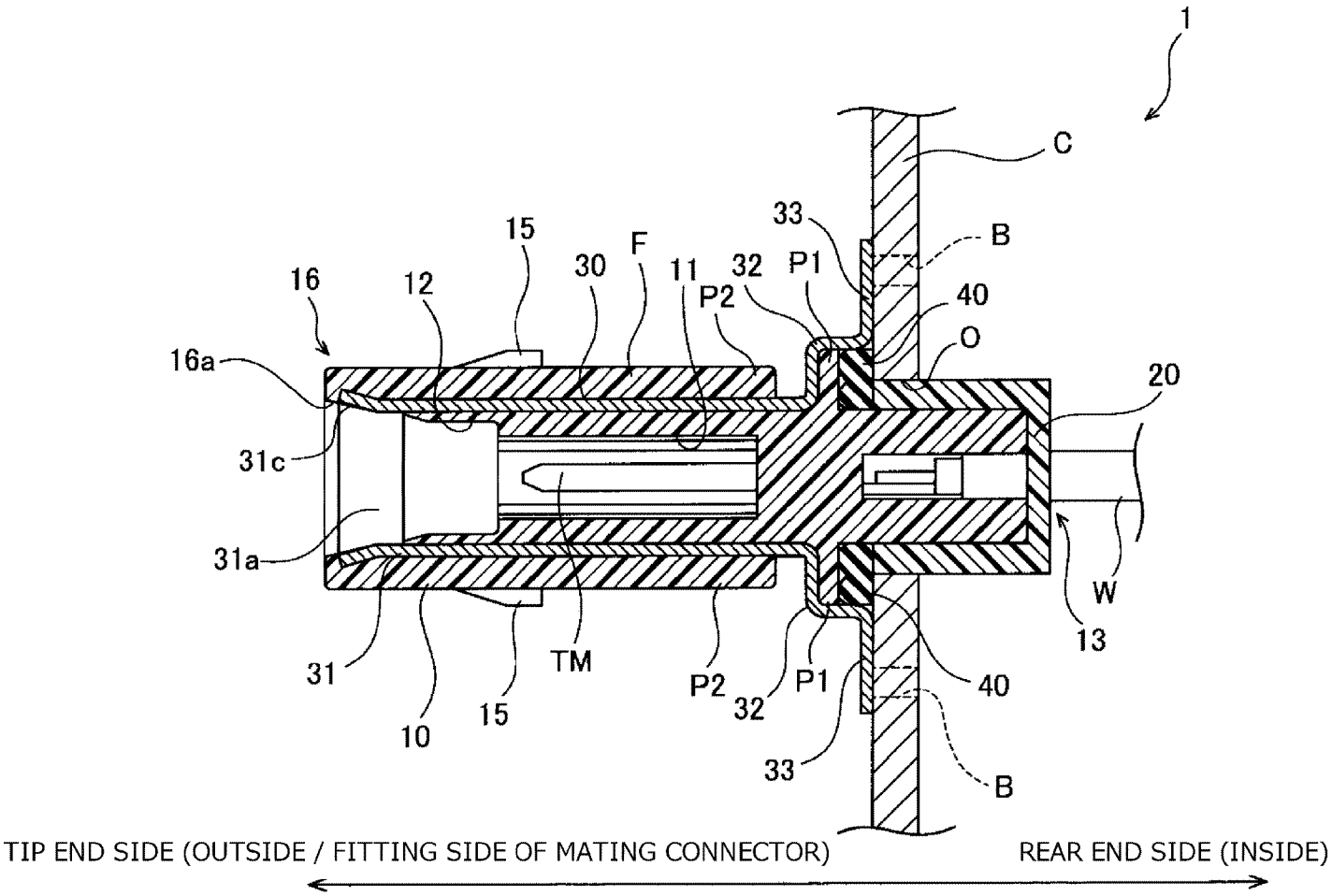
FIG. 3 is a sectional view showing the device direct-mounting shield connector, taken on line A-A of FIG. 2.

FIG. 2 is a perspective view showing the device direct-mounting shield connector 1 according to the first embodiment, and FIG. 3 is a sectional view showing the device direct-mounting shield connector 1, taken on line A-A of FIG. 2. The device direct-mounting shield connector 1 shown in FIGS. 1 to 3 is a connector that is directly connected to a casing C for housing on-vehicle components (a motor, an inverter, etc.) mounted on an electric vehicle, a hybrid vehicle, etc. The casing C is composed of a metallic member to ensure shield performance. The casing C configured as described above is provided with an opening section O, and the device direct-mounting shield connector 1 is installed in the opening section O of the casing C so as to be inserted thereinto. In the state of the device direct-mounting shield connector 1 being installed in the casing C shown in FIGS. 1 and 3, the tip end side of the device direct-mounting shield connector 1, that is, the fitting side thereof to be fitted to the mating connector 100, protrudes from the casing C.

The device direct-mounting shield connector 1 configured as described above is generally equipped with a connector housing 10, a rear holder 20, a shield shell 30 and a packing (waterproofing member) 40.

The connector housing 10 is made of a nonconductive synthetic resin and is equipped with an elliptically cylindrical hood section F protruding to the outside of the casing C. This hood section F is equipped with a terminal housing section 11, a step section 12 and a catching section 16.

The terminal housing section 11 houses conductive male terminals (terminals) TM. In the case that the mating connector 100 is fitted to the connector housing 10, the male terminals TM inside the terminal housing section 11 are connected to the female terminals TF of the mating connector 100 as shown in FIG. 1.

Still further, the connector housing 10 has the step section 12 on the tip end side thereof further ahead of the terminal housing section 11 shown in FIG. 3. The inside diameter of the step section 12 is made larger than that of the terminal housing section 11. When the mating connector 100 is fitted, the packing 130 of the mating connector 100 makes pressure contact with the step section 12 (see FIG. 1). Consequently, the terminal housing section 11 has a structure for preventing water intrusion from the tip end side of the connector housing 10 when the terminal housing section 11 is fitted to the mating connector 100.

The catching section 16 shown in FIG. 3 is a portion positioned on the tip end side of the connector housing 10 further ahead of the step section 12. The inside diameter of the catching section 16 is further made larger than that of the step section 12. The catching section 16 is provided with a catching face **16*a* on the inside of the hood section F. The catching face 16*a* is a portion formed into a tapered shape so as to have a diameter enlarged toward the tip end side and serves as a guide face for guiding the mating connector 100 so that the mating connector 100** is fitted easily.

Furthermore, the connector housing 10 is provided with an electric wire insertion section 13 on the rear end side thereof on the inside of the casing C. Electric wires W to which the male terminals TM are crimped, for example, are inserted into the electric wire insertion section 13.

The rear holder 20 is a member mounted on the electric wire insertion section 13. In the state in which the wires W with the terminals are inserted in the electric wire insertion section 13, the rear holder 20 is installed on the electric wire insertion section 13. The electric wires W with the terminals housed inside the terminal housing section 11 are preventing from coming off from the electric wire insertion section 13 by installing the rear holder 20. Moreover, the male terminals TM attached to the electric wires W in the terminal housing section 11 are prevented from coming off by lances, not shown.

Moreover, the connector housing 10 is provided with lock sections 15 on the outer wall portion thereof. The rock portions 15 function as engaging sections for preventing the mating connector 100 from coming off when the connector housing 10 is fitted to the mating connector 100.

The shield shell 30 is a metal cylindrical member covering the circumference of the terminal housing section 11. In this embodiment, the shield shell 30 is insert-molded and is in a state of being embedded in the connector housing 10. In other words, the shield shell 30 is embedded in the connector housing 10, integrated therewith and firmly fixed thereto.

However, the shield shell 30 is not limited so as to be integrated, but may be configured so as to be simply installed on the connector housing 10. The installation herein means that the shield shell 30 is installed so as not to be separated from the connector housing 10, whereby the shield shell 30 may merely be made inseparable from the housing 10 by sandwiching the shield shell 30 between the housing 10 and the casing C or by using other members.

The shield shell 30 configured as described above has a cylindrical section 31, a step section 32 and a fastening section 33. The cylindrical section 31 is formed into a nearly elliptical cylinder so as to be matched with the shape of the hood section F of the connector housing 10 and is positioned around the terminal housing section 11. The tip end side of the cylindrical section 31 is an exposed section 31*a* exposed from the inner face of the connector housing 10. This exposed section 31*a* is positioned on the tip end side of the connector housing 10 further ahead of the step section 12. In the case that the mating connector 100 is fitted, the exposed section 31*a* becomes a contact point with which the indent I of the shield shell 120 of the mating connector 100 makes contact.

The exposed section 31*a* includes a tapered inclined face 31*c* being continuous to (i.e., flush with) the catching face 16*a* as shown in FIG. 3. In other words, like the catching face 16*a*, the inclined face 31*c* of the exposed section 31*a* is a face having a diameter enlarged toward the tip end side.

The cylindrical section 31 is provided with an opening (not shown) so that, after the shield shell 30 is insert-molded in the connector housing 10, the shield shell 30 is prevented from falling off from the connector housing 10. This opening (not shown) is filled with a resin at the time of the insert-molding.

The step section 32 is formed on the rear end side of the shield shell 30 and is an enlarged diameter section having a diameter larger than that of the cylindrical section 31. On the rear face side of the step section 32 shown in FIG. 2, a portion P1 of the connector housing 10 is positioned as shown in FIG. 3. Furthermore, on the front face side (i.e., the tip end side) of the step section 32, another portion P2 of the connector housing 10 is positioned with a predetermined distance away therefrom. Hence, even if an excessive force is applied to the tip end side or the opposite side, i.e., the rear end side, of the shield shell 30, the step section 32 makes contact with the portion P1 or P2 of the connector housing 10, whereby the shield shell 30 is prevented from coming off.

The fastening section 33 is formed on the rear end side of the shield shell 30 and functions as an installation section to be installed on the casing C. The fastening section 33 is formed so as to expand wider to the outside of the cylindrical section 31 than the step section 32 and to extend in parallel with the peripheral face of the opening section O of the casing C.

The fastening section 33 configured as described above is composed of a base section 33*a* having a nearly elliptical shape and four extension sections 33*b* having a nearly semicircular shape and extended from the base section 33*a* to the outside as shown in FIG. 2. The four extension sections 33*b* are each provided with a through hole 33*c*. The casing C is provided with bolt holes B (see FIG. 3) at the positions corresponding to the through holes 33*c*. The shield shell 30 is fastened to the casing C by passing bolts into the through holes 33*c* and the bolt holes B and by tightening the bolts. The fastening section 33 (in particular, the four extension sections 33*b*) of the shield shell 30 to be fastened to the casing C is disposed outside the area waterproofed by the packing 40, described later.

In this embodiment, the shield shell 30 is integrated with the connector housing 10 by insert-molding. Hence, the connector housing 10 is also fixed to the casing C by fastening the shield shell 30 to the casing C with the bolts.

Although the shield shell 30 is not equipped with metal collars in this embodiment, the shield shell 30 may be provided with metal collars to enhance the fastening force to be applied to the casing C. In this case, the metal collars are provided on the tip end side from the fastening section 33 at the positions corresponding to the through holes 33*c*.

The packing 40 is, for example, a ring member made of rubber. The packing 40 prevents water from intruding from the opening section O via the clearance between the connector housing 10 and the casing C at the time when the device direct-mounting shield connector 1 is installed in the opening section O. More specifically, the packing 40 is a member disposed between the portion P1 of the connector housing 10 positioned on the rear face side of the step section 32 and the casing C and is pressed and deformed at the time when the shield shell 30 is fastened to the casing C with the bolts. Hence, the inner side portion of the device direct-mounting shield connector 1 from the packing 40 becomes the waterproof area.

The following explains a method for installing the device direct-mounting shield connector 1 according to this embodiment on the casing C and a method for fitting the device direct-mounting shield connector 1 to the mating connector 100.

First, the worker prepares the integrated structure of the connector housing 10 and the shield shell 30 and installs the packing 40 on the rear face side of the step section 32 of the shield shell 30. Next, the worker aligns the through holes 33*c* of the shield shell 30 with the bolt holes B of the casing C and fastens the shield shell 30 to the casing C with the bolts. Since the fastening section 33 is part of the shield shell 30 made of a metal, in the case that the fastening section 33 is fastened to the casing C with the bolts, unlike a resin-made flange, the fastening section 33 does not cause permanent set in fatigue and does not cause the problem of falling off of the bolts, whereby the metal collars themselves can be made unnecessary.

Next, the worker inserts the electric wires W to which the male terminals TM are attached beforehand through the electric wire insertion section 13 of the connector housing 10. With this insertion, the male terminals TM are engaged with the lances and are prevented from coming off. After the engagement by the lances, the worker installs the rear holder 20 on the electric wire insertion section 13 of the connector housing 10. After that, the worker fits the mating connector 100 housing the female terminals TF to the device direct-mounting shield connector 1.

At this time, the connector housing 110 of the mating connector 100 is guided by the catching section 16 so as to be fitted smoothly. Furthermore, since the catching face 16*a* is continuous to the inclined face 31*c* of the exposed section 31*a*, the connector housing 110 is hardly caught by the tip end of the exposed section 31*a*. Even if the connector housing 110 is caught by the tip end, the shield shell 30 is hardly deformed inward.

Hence, with the device direct-mounting shield connector 1 according to this embodiment, since the shield shell 30 constituting the contact point making contact with the shield shell 120 of the mating connector 100 is fastened to the casing C, even if the metal collars are provided, the metal collars are not required to be fixed to a resin-made member. Furthermore, since the problem of falling off of the bolts due to permanent set in fatigue in a resin-made flange does not occur, the metal collars themselves can be made unnecessary. Consequently, it is not necessary to ensure the size and the thickness of the flange, whereby the present invention can provide the device direct-mounting shield connector capable of being downsized.

Since the shield shell 30 is integrated with the connector housing 10 by embedding or press-fitting, a locking structure or the like is not required to assemble the two components with each other, and the connector itself is suppressed from being upsized. Moreover, since the fastening section 33 serving as the contact point portion of the shield shell 30 and the casing C is positioned outside the packing 40, this configuration can contribute to decreasing of the waterproof area, whereby the packing 40 and the opening section O of the casing C can be suppressed from being upsized and the connector itself can eventually be suppressed from being upsized. Consequently, the present invention can provide the device direct-mounting shield connector 1 capable of being further downsized.

What's more, since the exposed section 31*a* including the tapered inclined face 31*c* being continuous to the catching face 16*a* is exposed, the shield shell 30 is enlarged in diameter toward the tip end side. Even if the mating connector 100 makes slide contact with or collides with the end section of the exposed section 31*a*, the shield shell 30 can be made hardly deformed inward.

Next, a second embodiment according to the present invention will be described. Although a device direct-mounting shield connector according to the second embodiment is similar to that according to the first embodiment, they are different from each other in some configurations. The following will explain the differences from the first embodiment.

Figure 4:
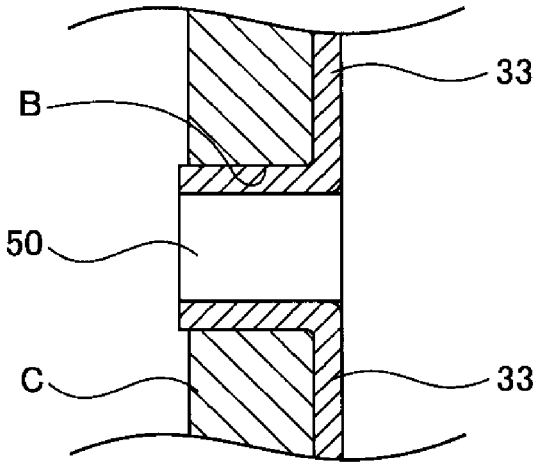
FIG. 4 is an enlarged view showing the contact point portion of the device direct-mounting shield connector and the casing according to the second embodiment.

FIG. 4 is an enlarged view showing the contact point portion of the device direct-mounting shield connector 1 and the casing C according to the second embodiment. As shown in FIG. 4, the device direct-mounting shield connector 1 according to the second embodiment is further equipped with metal collars 50. These collars 50 are fitted inside the bolt holes B of the casing C and are different from the collars described in the first embodiment.

The collars 50 according to the second embodiment are formed by drawing the fastening section 33 and are integrated with the shield shell 30. Although the collars 50 are formed by drawing and integrated with the shield shell 30 in the example shown in FIG. 4, the method for forming the collars 50 is not limited to the drawing. For example, the collars 50 may be integrated by welding metal collars. Furthermore, the collars 50 may be connected to the shield shell 30, for example, by crimping or press-fitting.

In the device direct-mounting shield connector 1 having the collars 50 configured as described above, the collars 50 fitted in the bolt holes B also function as the contact point portions making contact with the casing C. In other words, the collars 50 serve as portions of the shield shell 30 and function as the contact point portions making contact with the casing C. Hence, the area of the shield shell 30 making contact with the casing C is increased, whereby this configuration contributes to utilization of a stable shielding effect.

In the second embodiment, the collars 50 are integrated or connected before the shield shell 30 is insert-molded in the connector housing 10.

Hence, with the device direct-mounting shield connector 1 according to the second embodiment, as in the first embodiment, the present invention can provide the device direct-mounting shield connector 1 capable of being (further) downsized. In addition, the shield shell 30 can be made hardly deformed inward.

Furthermore, with the second embodiment, since the metal collars 50 are integrated with or connected to the shield shell 30, the area of the shield shell 30 making contact with the casing C is increased by the portions of the collars 50, whereby this configuration can contribute to utilization of a stable shielding effect.

Although the present invention has been described above on the basis of the embodiments, the present invention is not limited to the above-mentioned embodiments, but the present invention may be modified or the technologies described in the respective embodiments may be combined appropriately within the scope not departing from the gist of the present invention. Furthermore, the technologies of the present invention may be combined appropriately with other technologies in a possible range.

For example, the male terminals TM are housed in the terminal housing section 11 in this embodiment. However, instead of being limited to this, the female terminals TF may be housed therein.

Moreover, in this embodiment, the shield shell 30 is insert-molded and embedded in the connector housing 10, thereby being integrated therewith. However, instead of being limited to this configuration, the shield shell 30 may be press-fitted in the clearance formed in the connector housing 10 and integrated therewith. What's more, the shield shell 30 may be formed of two components; one component may be insert-molded and the other component may be welded to the one component. More and more, the shield shell 30 may be simply installed in the connector housing 10 instead of using the insert-molding or press-fitting.

Still further, in this embodiment, the connector housing 10 is provided so as to pass through the opening section O, and the shield shell 30 is positioned on the outside of the casing C. However, instead of being limited to this, if possible, the shield shell 30 may be provided so as to pass through the opening section O, or the connector housing 10 may be provided so as to be positioned only on the outside of the casing C.

What is claimed is:

1. A device direct-mounting shield connector configured to be installed in an opening section formed in a metal casing, comprising:

a nonconductive connector housing having a cylindrical hood section including a terminal housing section for housing a conductive terminal, and the connector housing being configured to be fitted with a mating connector from a tip end side of the connector housing; and a metal shield shell installed in the connector housing and that covers a circumference of the terminal housing section, wherein the shield shell integrally has an exposed section and a fastening section;

wherein in a state that the shield shell is installed in the connector housing, the exposed section is exposed to an inside of the hood section and is configured to contact to a shield shell of the mating connector when the mating connector is fitted with the connector housing; and wherein the fastening section has a through hole and is formed at a rear end side of the connector housing on the opposite side of the tip end side, and the fastening section of the shield shell abuts the casing and is fastened directly to the casing by passing a bolt into the through hole provided in the fastening section and a bolt hole formed in the casing and by tightening the bolt.

2. The device direct-mounting shield connector according to claim 1, further comprising:

a waterproofing member configured to prevent water from intruding from the opening section via a clearance between the connector housing and the casing in a state that the connector housing is installed in the opening section, wherein the shield shell is integrated with the connector housing by embedding or press-fitting, and the fastening section is fastened to the casing at an outside of the waterproofing member.

3. The device direct-mounting shield connector according to claim 1, wherein a catching face is formed at the tip end side of the connector housing so as to be enlarged in diameter in a tapered shape to catch the mating connector; and wherein the exposed section of the shield shell has a tapered inclined face being continuous to and flush with the catching face.

4. The device direct-mounting shield connector according to claim 1, further comprising:

a metal collar installed in the bolt hole of the casing, wherein the collar is integrally formed with or connected to the shield shell.

5. The device direct-mounting shield connector according to claim 1, wherein the fastening section has a base section that abuts the casing.

6. The device direct-mounting shield connector according to claim 1, wherein the shield shell is enlarged in diameter toward the tip end side.

7. The device direct-mounting shield connector according to claim 1, wherein the shield shell is insert-molded and embedded inside the connector housing.

* * * * *